United States Patent [19]

Shenker et al.

[11] Patent Number: 4,667,573

[45] Date of Patent: May 26, 1987

[54] FLUID ACTUATOR DEVICES

[75] Inventors: Leonid Shenker, Kiron; Shimon Lemelman, Bat-Yam, both of Israel

[73] Assignee: Lantas Development and Industries (1984) Ltd., Tel Aviv, Israel

[21] Appl. No.: 723,754

[22] Filed: Apr. 16, 1985

[30] Foreign Application Priority Data

Dec. 28, 1984 [IL] Israel ..... 73961

[51] Int. Cl.[4] ..... F01B 19/00

[52] U.S. Cl. ..... 92/48; 92/92

[58] Field of Search ..... 92/48, 92, 76; 251/59, 251/61

[56] References Cited

U.S. PATENT DOCUMENTS

| | | | |
|---|---|---|---|
| 2,463,900 | 3/1949 | Nicholson | 92/48 |
| 2,509,673 | 5/1950 | Church | 92/48 |
| 2,792,022 | 5/1957 | Mercier | 92/92 |
| 3,137,214 | 6/1964 | Feld et al. | 92/48 |
| 3,229,590 | 1/1966 | Huska | 92/48 |
| 3,379,411 | 4/1968 | Vanderjagt | 92/92 |
| 3,495,502 | 2/1970 | Bousso | 92/92 |
| 3,650,181 | 3/1972 | Parr | 92/48 |
| 3,783,746 | 1/1974 | Jacobelus | 92/92 |
| 3,963,386 | 6/1976 | Hirmann | 92/92 |
| 3,975,989 | 8/1976 | Hirmann | 92/48 |

*Primary Examiner*—James C. Yeung

*Attorney, Agent, or Firm*—Benjamin J. Barish

[57] ABSTRACT

A fluid actuator comprises a rigid housing having a reciprocating member, a tubular hose section having a straight length bearing against one face of the reciprocating member and connectible to a first port for introducing pressurized fluid to cause it to inflate and thereby to drive the reciprocating member rectilinearly in one direction, and a return member, e.g., a second tubular hose section, having a straight length bearing against the opposite face of the reciprocating member and connectible to a second port for introducing pressurized fluid to cause it to inflate and thereby to drive the reciprocating member rectilinearly in the opposite direction.

13 Claims, 9 Drawing Figures

FIG.1
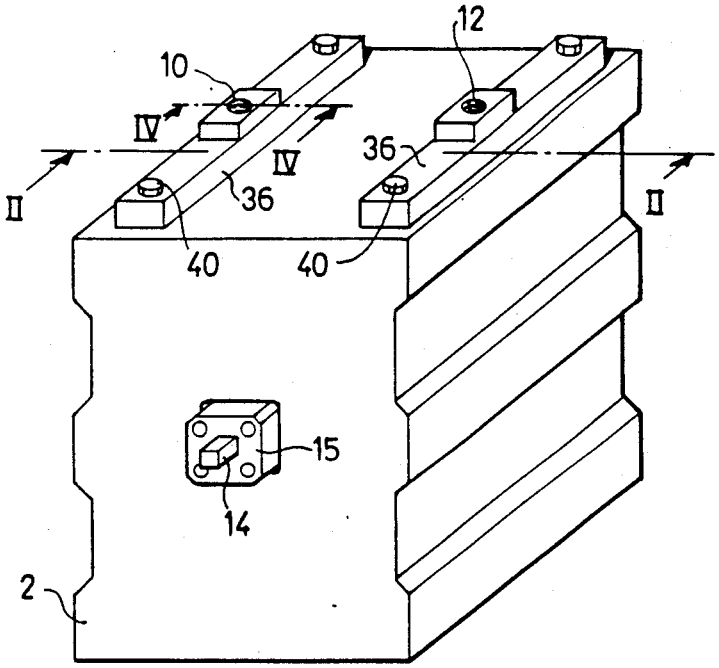
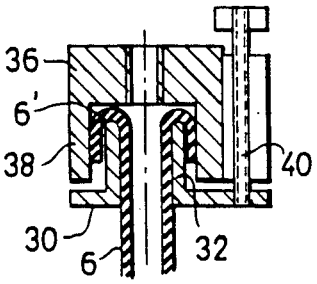
FIG.4
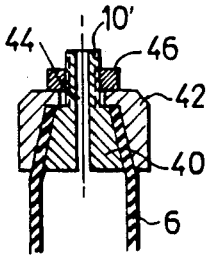
FIG 4a
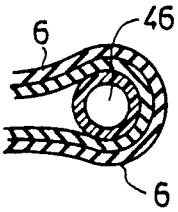
FIG 5
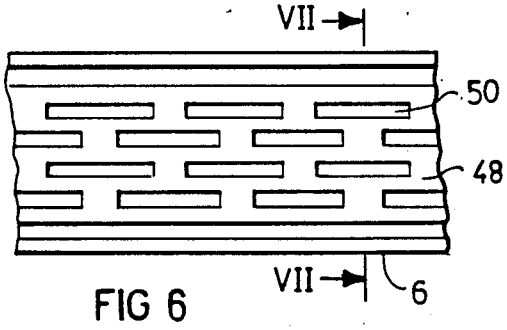
FIG 6
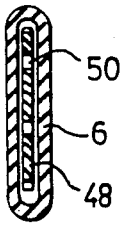
FIG.7

FLUID ACTUATOR DEVICES

BACKGROUND OF THE INVENTION

The present invention relates to fluid actuators, and particularly to pneumatic or hydraulic actuators.

Fluid actuators are now widely used for controlling valves, such as butterfly valves or ball valves having angularly-movable value operators. Most of these valves are usually of the pneumatic type driven by compressed air, although some are of the hydraulic type driven by a hydraulic liquid, such as oil. Usually, the valve operator is driven about 90° from its open to its closed positions.

Probably the most popular fluid actuator presently used is the cylinder-type wherein the driving fluid reciprocates a piston, the actuator including means for converting the piston reciprocations into angular movements of an output shaft. Such actuators, however, are complicated and expensive in construction.

Another actuator now in use is of the vane type, wherein the driving fluid acts directly on a rotating vane rigidly coupled to the output shaft. This type, as well as the first-mentioned type, requires high quality internal surfaces to decrease friction, which requirement increases the manufacturing costs substantially.

A further actuator now in use is the diaphragm-type wherein the driving fluid reciprocates a diaphragm, the reciprocations of the diaphragm being converted into angular movements of an output shaft. The known actuators for this type, however, require bulky constructions.

An object of the present invention is to provide a new type of fluid actuator having advantages in the above respects.

SUMMARY OF THE INVENTION

According to the present invention, there is provided a fluid actuator comprising a rigid housing having a first port and a second port; a reciprocating member disposed within the housing; a tubular hose disposed within the housing and having a first section one side of the reciprocating member and a second section on the opposite side of the reciprocating member; and securing means securing an intermediate portion of the tubular hose to the reciprocating member and pinching closed the tubular hose at the intermediate portion between the first and second sections. The first section of the tubular hose has a length bearing against one face of the reciprocating member and is secured at one end to the first port of the housing. The second section of the tubular hose has a length bearing against the opposite face of the reciprocating member and is secured at one end to the second port of the housing. The arrangement is such that introducing pressurized fluid via the first port into the first section of the tubular hose causes it to inflate and thereby to drive the reciprocating member in one direction, and introducing pressurized fluid via the second port into the second section of the tubular hose cause it to inflate and thereby to drive the reciprocating member in the opposite direction.

In the preferred embodiment of the invention described below, both the first and second sections of the tubular hose include a plurality of folds parallel to their respective faces of the reciprocating member.

According to a further feature, the securing means for securing each end of the hose comprises an inner channel member extending across the respective hose end and having a pair of upstanding legs engageable with the hose end, the latter being turned outwardly around the upstanding legs; an outer channel member extending across the respective hose end and having a pair of depending legs receiving the upstanding legs of the inner channel member with the hose end therebetween; and a fastener for securing the channel members together with the hose end clamped inbetween.

In the described preferred embodiment, the two hose sections are constituted of a single hose having its opposite ends secured to said housing in communication with said first and second ports, respectively, and secured at its intermediate portion to said reciprocating member.

BRIEF DESCRIPTION OF THE DRAWINGS

The invention is herein described, by way of example only, with reference to the accompanying drawings, wherein:

FIG. 1 is a three-dimensional view, illustrating one form of fluid actuator constructed in accordance with the present invention;

FIG. 4 is an enlarged, fragmentary, sectional views along lines IV—IV of FIG. 1;

FIG. 4*a* illustrates a variation of FIG. 4;

FIGS. 5 and 6 illustrate two options for maintaining passageways through the inflatable hose;

FIG. 7 is a sectional view along lines VII—VII of FIG. 6. and

DESCRIPTION OF PREFERRED EMBODIMENTS

Figure 2:
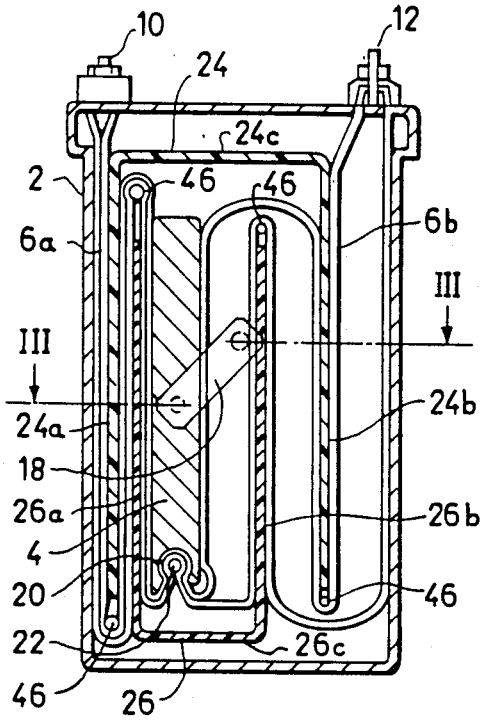
FIGS. 2 and 3 are sectional views along lines II—II and III—III of FIGS. 1 and 2, respectively
Figure 3:
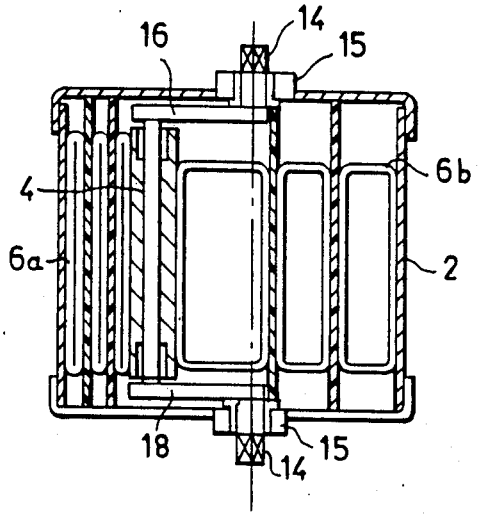

The fluid actuator illustrated in FIGS. 1-3 of the drawings comprises a rigid housing 2, and a reciprocating plate 4 disposed within the housing and driven in the forward and return directions by drive means in the form of a folded tubular hose, generally designated 6. Thus, hose 6 comprises a first folded section 6*a* disposed on one side of reciprocating plate 4, and a second hose section 6*b* disposed on the opposite side of the reciprocating plate. Hose section 6*a* is inflated and deflated via port 10 in the housing on one side of reciprocating plate 4, and hose section 6*b* is inflated and deflated via port 12 in the housing on the opposite side of the reciprocating plate.

The actuator further includes a rotary output shaft 14 supported in a rotary bearing 15, and a pair of links 16 and 18 coupling reciprocating plate 4 to shaft 14 so as to convert the reciprocating movements of the plate into angular movements of the shaft. The arrangement may be such that the reciprocation of plate 4 in one direction rotates shaft 14 approximately 90°, and the reciprocation of the plate in the opposite direction returns the shaft to its original position.

The two hose sections 6*a* and 6*b* are constituted of a single hose having its opposite ends secured to the housing in communication with ports 10 and 12, respectively, and its intermediate portion secured to reciprocating plate 4. For purposes of securing the intermediate portion of the hose to reciprocating plate 4, the latter plate is formed with a substantially circular recess 20 in its lower edge, and the intermediate portion of hose 6, i.e. between its two sections 6*a*, 6*b*, is inserted within this recess and is secured therein by a pin 22.

This permits hose 6 to be conveniently attached and detached from reciprocating plate 4, and at the same time it effectively divides hose 6 into its two sections 6*a*, 6*b* for inflation and deflation via their respective ports 10, 12.

Each of the two hose sections 6*a*, 6*b* is formed with a plurality of folds, three such folds being shown for purposes of example. The arrangement is such that to drive reciprocating plate 4 in the forward direction, pressurized fluid, e.g. air, is introduced into one port, e.g. 10, to cause its respective hose section 6*a* to open its folds, whereas the air from the other section 6*b* is exhausted via its port 12 to permit plate 4 to move in the direction of causing hose section 6*b* to close its folds. To drive the reciprocating plate in the return direction, pressurized air is introduced via the other port 12 to cause its hose section 6*b* to expand its folds, while the air is exhausted from section 6*a* via its port 10.

The illustrated actuator further includes two U-shaped separator members 24, 26, to separate the folds of the two hose sections 6*a*, 6*b* from each other. Thus, separator member 24 comprises a first leg 24*a* between the outer and intermediate folds of hose section 6*a*, another leg 24*b* between the outer and intermediate folds of hose section 6*b*, and a bridge 24*c* connecting the two legs and straddling one end of reciprocating plate 4. Separator member 26 similarly includes a first leg 26*a* between the intermediate and inner folds of hose section 6*a*, a second leg 26*b* between the intermediate and inner folds of hose section 6*b*, and a bridge 26*c* connecting the two legs together and straddling the opposite end of reciprocating plate 4. The legs of these two separator members 24, 26 are preferably bonded, e.g. by an adhesive, to the hose sections so as to prevent sliding between the contacting surfaces. Similarly, the outer surfaces of the hose sections contacting the reciprocating plate 4 and the inner face of housing 2 are also bonded to these surfaces, so as to prevent relative lateral movement between the folds of the hose sections during their inflation and deflation.

FIG. 4 more particularly illustrates the manner of securing the two ends of hose 6 to the housing 2. Thus, the securing means comprises an inner channel member 30 extending across the respective hose end and having a pair of upstanding legs 32. The hose 6 is passed through a slot 34 in the inner channel member 30 and through the space between its two legs 32, the outer end of the hose being turned outwardly, as shown at 6'. An outer channel member 36 having a pair of depending legs 38 is received over legs 32 of channel member 30, and fasteners 40 are then applied to secure the two channel members 30 and 36 together with the hose end 6' clamped between them.

FIG. 4*a* illustrates another manner of attaching the hose end to the housing in communication with the port, therein designated 10', the same arrangement being provided for attaching the opposite end of the hose in communication with the other port 12. Thus, as shown in FIG. 4*a*, port 10' is constituted of a stem integrally formed on an inner member 40 which is receivable within the respective end of the hose 6. Member 40 has an outer conical face which is engageable with the inner face of the hose end. An outer member 42, formed with a conical inner face complementary to that of the outer face of member 40, is received over member 40 to engage the outer face of hose 6. Member 42 is further formed with an opening 44 through which passes stem 10', and a nut fastener 46 is then threaded on to stem 10 so as to secure the two members 40 and 42 together with the hose end clamped between them.

To better assure that the folds will properly open when the respective hose section is inflated, a separator rod 46 is interposed between the folds at their junctures. As shown in FIG. 5, the separator rods are preferably of tubular configuration.

Another arrangement to assure that the hose sections will properly inflate when pressurized air is introduced is shown in FIGS. 6 and 7. This arrangement includes a separator member 48 disposed within the hose 6. Separator member 48 is of a resilient sheet material (e.g., rubber or plastic) formed with a plurality of rectangular openings 50 therethrough, and is of a width less than the diameter of the hose in its deflated condition to assure the maintenance of a passageway through the hose when it is to be inflated.

The operation of the illustrated actuator will be apparent from the above description. Thus, in order to rotate the output shaft in the forward direction, pressurized air is applied via port 10 into hose section 6*a* on one side of reciprocating plate 4, whereas the hose section 6*b* on the opposite side of reciprocating plate is exhausted via its port 12. The pressurized air thus applied to hose section 6*a* causes that hose section to expand its folds, thereby driving plate 4 in one direction. In order to drive it in the opposite direction, pressurized air is applied to port 12 to cause hose section 6*b* to expand its folds, whereas hose section 6*a* is exhausted via its port 10. The reciprocation of plate 4 is converted to a rotary motion by means of the links 16, 18.

It will thus be seen that the illustrated fluid actuator is of simple construction which can be manufactured at low cost and which produces relatively high torque. In addition, the actuator is insensitive to dirt particles in the driving fluid, and therefore does not require filters. Further, the actuator can operate as a pneumatic acutator using compressed gas, or as a hydraulic actuator using compressed oil, water or other liquid, according to what is available at the site.

Figure 8:
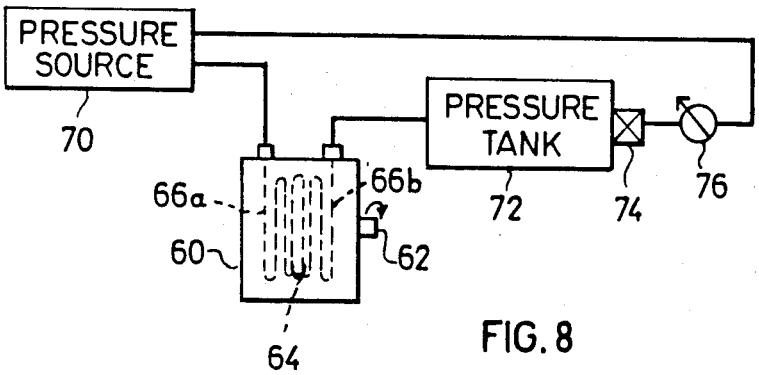
FIG. 8 diagrammatically illustrates an example of an application of the actuator.

FIG. 8 illustrates one arrangement which may be used for driving the fluid actuator, therein designated 60, and having an output rotary shaft 62 driven by a reciprocating plate 64 which is reciprocated by two folded hose sections 66*a*, 66*b* on opposite sides of the reciprocating plate. Thus, hose section 66*a* is inflated by a pressure source 70 for driving reciprocating plate 64 in one direction, and hose section 66*b* is inflated by a pressure tank 72 for driving reciprocating plate in the return direction. Pressure tank 72 is supplied from the same pressure source 70 via a pressure regulator 76 and a one-way valve 74. As one example, pressure source 70 could be at 5 atmospheres, and pressure tank 72 could be maintained at two atmospheres under the control of pressure regulator 76.

Thus, the application of pressure source 70 to hose section 66*a* causes the latter to inflate and to drive plate 64 rightwardly, this being permitted by the deflation of hose section 66*b* into pressure tank 72 maintained at a lower pressure than source 70. When pressure source 70 is turned off, the pressure in tank 72 then inflates hose section 66*b*, driving plate 64 in the return direction.

The illustrated actuator is useful for many different applications, including: driving valves in fluid or gas transportation and distribution systems; driving remotely-controlled doors and dampers; driving turntables, manipulators and other mechanisms; and driving production equipment, such as bending, cutting or punching machines.

It will be appreciated that many other variations of the invention may be made. For example, the actuator could include a spring return, or two separate hose sections, or the opposite ends of the single-section or 2-section hose could be secured to the housing rather than to the reciprocating plate. Many other variations, modifications and applications of the invention will be apparent.

What is claimed is:

1. A fluid actuator comprising:

a rigid housing having a first port and a second port;

a reciprocating member disposed within said housing;

a tubular hose disposed within said housing and having a first section on one side of said reciprocating member and a second section on the opposite side of said reciprocating member;

securing means securing an intermediate portion of said tubular hose to said reciprocating member and pinching closed said tubular hose at said intermediate portion between said first and second sections;

said first section of the tubular hose having a length bearing against one face of said reciprocating member and being secured at one end to said first port of the housing;

said second section of the tubular hose having a length bearing against the opposite face of said reciprocating member and being secured at one end to said second port of the housing:

whereby introducing pressurized fluid via said first port into said first section of the tubular hose causes it to inflate and thereby to drive said reciprocating member in one direction, and introducing pressurized fluid via said second port into said second section of the tubular hose causes it to inflate and thereby to drive said reciprocating member in the opposite direction.

2. The fluid actuator according claim 1, wherein both said first and second sections of the tubular hose include a plurality of folds parallel to their respective faces of the reciprocating member.

3. The actuator according to claim 2, including means preventing the lateral movement between the folds of each hose section.

4. The actuator according to claim 2, further including a separator member between the folds of each fold section.

5. The actuator according to claim 2, wherein there are at least three folds on each of the two opposite sides of said reciprocating member, said housing further including two U-shaped separator members, one separator member having a pair of legs each interposed between a first and second fold on the opposite sides of the reciprocating member and joined together by a bridge straddling one end of the reciprocating member, the other separator member having a pair of legs each interposed between said second and a third fold on the opposite sides of the reciprocating member and joined together by a bridge straddling the opposite end of the reciprocating member.

6. The actuator according to claim 2, further including separator rods interposed between the folds at their junctures.

7. The actuator according to claim 2, wherein each of said hose sections includes an inner separator member disposed within the respective hose section and having a width less than the diameter thereof in its deflated condition to assure the maintenance of a passageway therethrough, said inner separator member being of sheet material formed with a plurality of openings therethrough.

8. The actuator according to claim 1, wherein said reciprocating member is a plate formed with a recess in one end thereof, said intermediate portion of the hose being received in said recess and secured therein by means of a pin received within said recess.

9. The actuator according to claim 1, further including a rotary output shaft, and a coupling between said reciprocating member and said rotary output shaft converting the reciprocating movements of the member into angular movements of the shaft.

10. The actuator according to claim 1, wherein each of said ports includes an inner member receivable within the end of the hose section and formed with an outer conical face engageable with the inner face of the hose, and with a stem projecting outwardly of said hose end; an outer member receivable over the end of the hose section and formed with an inner conical face complementary to that of said inner member and engageable with the outer face of the hose; and a fastener secured to said stem of the inner member for clamping the two members together with said hose end inbetween; said inner member and stem being formed with a through-going bore for the introduction of the pressurized fluid.

11. The actuator according to claim 1, wherein the hose end section is secured to the housing by an inner channel member extending across the respective hose end and having a pair of upstanding legs engageable with the hose end turned outwardly, an outer channel member extending across the respective hose end and having a pair of depending legs receiving the upstanding legs of the inner channel member with the hose end therebetween, and a fastener for securing said two channel members together with the hose end clamped inbetween.

12. The actuator according to claim 1, wherein one of said ports is connected to a source of pressurized fluid, and the other of said ports is connected to a pressure tank supplied from said source of pressurized fluid via a pressure regulator.

13. A fluid actuator comprising:

a rigid housing having a first port and a second port;

a reciprocating member disposed within said housing;

a tubular hose disposed within said housing and having a first section on side of said reciprocating member and a second section on the opposite side of said reciprocating member;

securing means securing an intermediate portion of said tubular hose to said reciprocating member and pinching closed said tubular hose at said intermediate portion between said first and second sections;

said first section of the tubular hose having a length bearing against one face of said reciprocating member and being secured at one end to said first port of the housing;

said second section of the tubular hose having a length bearing against the opposite face of said reciprocating member and being secured at one end to said second port of the housing;

each hose section being secured to the housing by an inner channel member extending across the respective hose end and having a pair of upstanding legs engageable with the hose end turned outwardly, an outer channel member extending across the respective hose end and having a pair of depending legs receiving the upstanding legs of the inner channel member with the hose end therebetween, and a fastener for securing said two channel members together with the hose end clamped inbetween.

* * * * *